US005570476A

United States Patent [19]

Olive

[11] Patent Number: 5,570,476

[45] Date of Patent: Nov. 5, 1996

[54] HEAD COVER PROVIDING SELECTIVE RADIATION SHIELDING

[76] Inventor: Bruce B. Olive, 5821 Mount Sinai Rd., Durham, N.C. 27705

[21] Appl. No.: 389,355

[22] Filed: Feb. 16, 1995

[51] Int. Cl.[6] ..... A42B 1/00

[52] U.S. Cl. ..... 2/200.1; 2/7; 2/171; 2/172; 2/195.1; 2/410

[58] Field of Search ..... 2/7, 195.1, 172, 2/171, 200.1, 8, 175.1, 410, 411, 412; 250/516.1; 607/1

[56] References Cited

U.S. PATENT DOCUMENTS

| | | | |
|---|---|---|---|
| 3,164,840 | 1/1965 | Reynolds . | |
| 4,278,435 | 7/1981 | Ebneth | 8/471 |
| 4,338,686 | 7/1982 | Bell | 2/93 |
| 4,390,588 | 6/1983 | Ebneth et al. | 428/263 |
| 4,420,757 | 12/1983 | Ebneth et al. | 343/912 |
| 4,439,768 | 3/1984 | Ebneth et al. | 343/18 B |
| 4,572,960 | 2/1986 | Ebneth et al. | 250/516.1 |
| 5,073,984 | 12/1991 | Tone et al. | 2/2 |

FOREIGN PATENT DOCUMENTS

| | | | |
|---|---|---|---|
| 239371 | 10/1925 | United Kingdom | 2/7 |

OTHER PUBLICATIONS

Trade literature sheet describing Flexton Metallized Materials by Monsanto dated Aug. 18, 1994.

Monsanto advertising leaflet entitled "Flectron™ Metallized Materials for EMI/RFI Shielding" (2 sheets).

Monsanto advertising brochure entitled "Flectron Metallized Materials—Presenting A New Force In Metallized Products" (8 Sheets).

Article from Sep., 1984 issued of "International Journal of Aviation Safety" entitled Metallised fabrics, their properties and technical applications, by Harold Ebneth.

"Noise Reduction Techniques in Electronic Systems" by Henry W. Ott (Title page, copyright page and pages 188 and 189).

*Primary Examiner*—Diana Beifeld

*Attorney, Agent, or Firm*—Olive & Olive, P.A.

[57] ABSTRACT

A cap is formed of a metallized fabric capable of being fabricated with conventional cut and sew techniques into a baseball style cap and serviceable both as a head covering and as a means for shielding the head of the wearer and attenuating selected electric field, electromagnetic field or other radio frequencies which, unless shielded and attenuated, would pass through the cap and provide a cause of concern for the wearer of the cap.

9 Claims, 4 Drawing Sheets

HEAD COVER PROVIDING SELECTIVE RADIATION SHIELDING

FIELD OF INVENTION

The invention relates to head covers and particularly to a head cover in the form of a cap. More specifically, the invention is directed to a cap fabricated in such a manner that when worn on a person's head, the head is shielded from selected forms of radiation.

BACKGROUND OF INVENTION

Caps, hats and other forms of head covers, are typically made of some kind of fabric selected primarily for its ability to shield the wearer's head from the rays of the sun, from cold weather or from moisture. A very popular kind of cap is referred to by many as a "baseball" cap irrespective of whether it is being used in some kind of sport, for hunting, for work or other application. Such a cap typically comprises a flexible portion which covers the head and an outer relatively stiff panel portion which provides shade for the eyes. The head cover portion is called the crown and the shade portion is referred to as the bill.

A typical method of fabricating a baseball cap of the type referred to is to precut a selected number of panels from a sheet of fabric and seam these together to form the crown to which the bill is attached. For purposes of adjustment to different head sizes, the cap is typically fitted with an adjustable strap at the rear of the cap and a somewhat inverted U-shape opening is left in the crown portion above the location of the strap. In some types of caps of the kind being described, a large portion and sometimes the entire portion of the crown, is formed of a porous net material. In some instances, the fabric composite from which the crown panels are cut comprises an outer cloth layer which may be either natural or synthetic and a thin inner layer which also may be either natural or synthetic and which is bonded to the outer layer to form an inner lining for the cap.

So far as is known, the popular type of cap described has never been fabricated in a form suited to the purpose of shielding the head from radiation such as emitted by television sets, microwave ovens, citizens-band (CB) radios, cordless telephones and the like. Yet, there is increasing concern and numerous studies and research articles indicate there is cause for concern when a person for whatever reason is continuously exposed to certain frequencies. This concern centers to a great concern on potential damage to the brain.

The technology for making surface metallized fabrics suited for use as personal protective clothing is described in U.S. Pat. Nos. 3,164,840; 4,420,757; 4,278,435; 4,439,768; and 4,572,960 the teachings of which are incorporated herein by reference.

A radiation protective garment having a head covering formed of a metallized fabric is described in U.S. Pat. Nos. 3,164,840; 4,338,686; and 4,572,960 and more recently in U.S. Pat. No. 5,073,984, the teachings of which patents are incorporated herein by reference.

The fabrics, referred to above as surface metallized fabrics, are now being produced and sold so far as applicant is aware, primarily for industrial applications as for example, being applied somewhat like wallpaper to shield a room from electric field, electromagnetic field, and other radio frequency interference. One such fabric is sold under the trademark "Flectron" by Monsanto Chemical Company of St. Louis, Mo. So far as is known, no one has heretofore recognized either the possibility or suitability of applying such shielding material to the manufacture of the popular and widely used baseball-type cap so as to make the cap a selective frequency shielding device for the head without impairing the ability of the cap to be a baseball-type cap bead cover.

SUMMARY OF INVENTION

The present invention recognizes that the type of metallized fabric presently being produced for radiation shielding in industrial applications exhibits characteristics suitable for fabrication of caps of the type described above in that such fabrics are light weight, drapable, easily cut, easily sewn and of attractive appearance. Thus, the present invention is directed to providing a baseball-type cap which can serve both as a head cover and as a shield for shielding the brain of the wearer by attenuating certain frequencies determined by the nature of the fabric.

DESCRIPTION OF THE INVENTION

Figure 1:
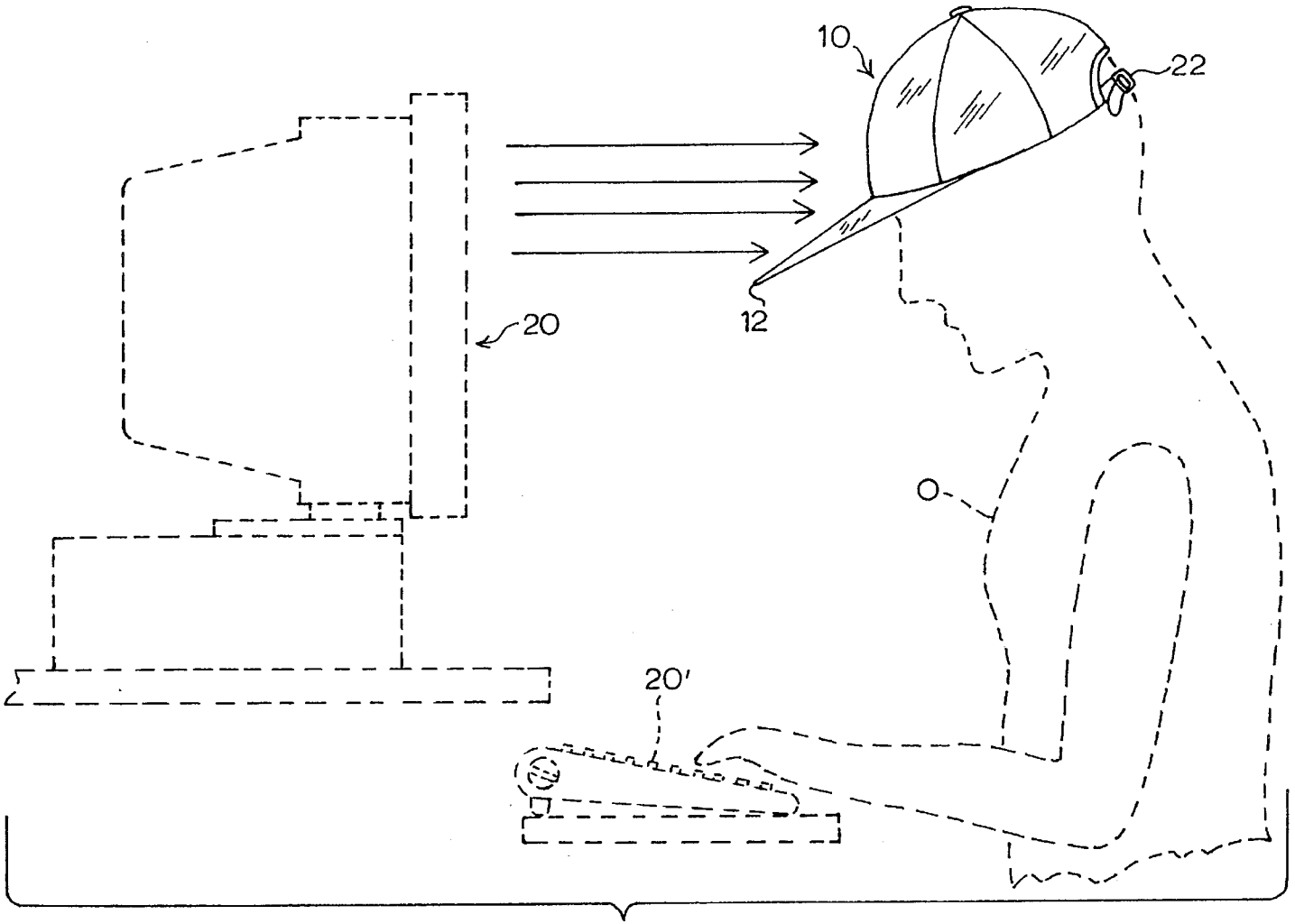
FIG. 1 is a somewhat schematic view illustrating the cap of the invention in use in an environment in which, by way of example, undesired radiation is emitted by a computer screen.
Figure 5:
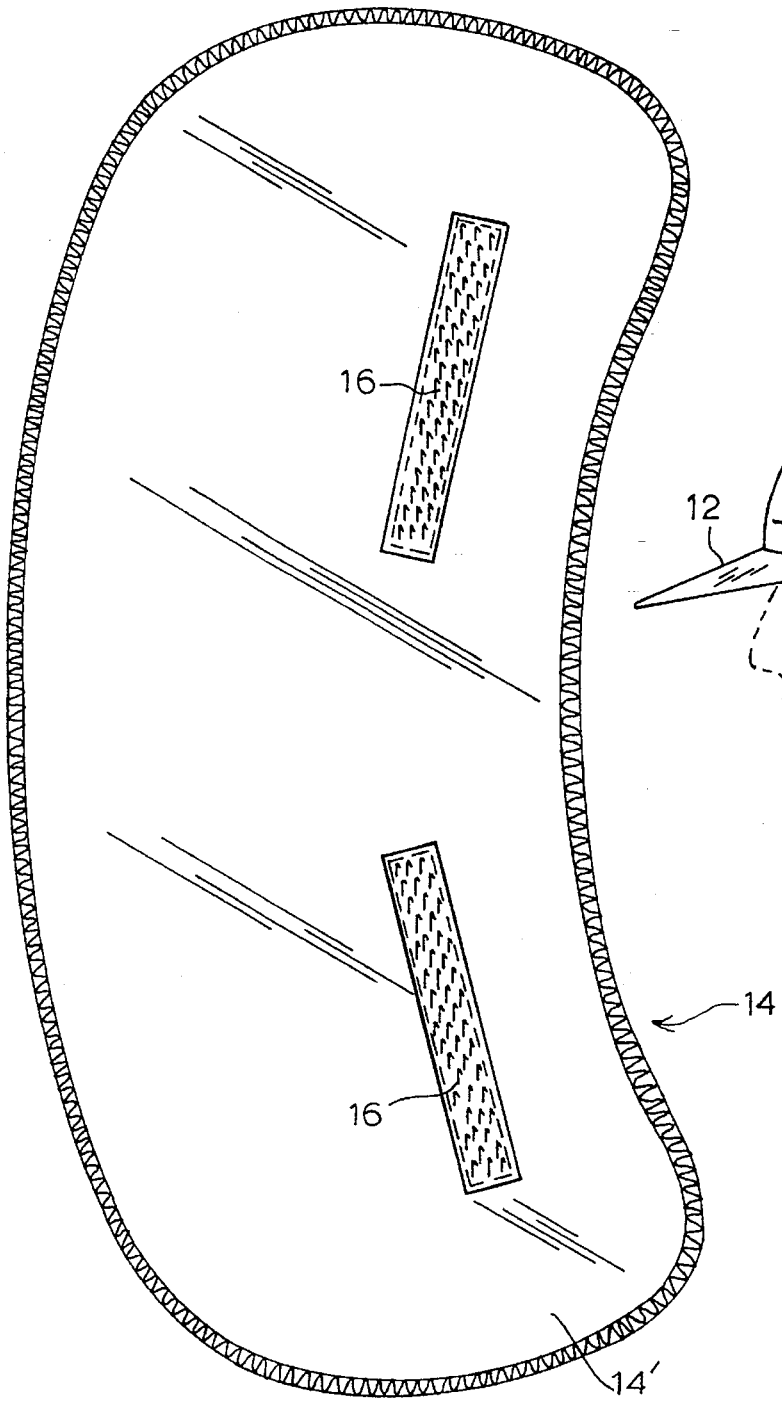
FIG. 5 is an enlarged outside view of the drape shown in FIG. 2 but detached from the crown of the cap.

The cap 10 of the invention has the important advantage that it can be manufactured by conventional cut and sew and other practices known in the art of manufacturing baseball caps. In this regard, as an initial step of manufacture, a metallized textile fabric is selected according to the desired frequencies to be shielded, the weight, drapability and appearance of the fabric. The term "metallized textile fabric" is intended to include any of the numerous types of available metallized fabrics suited to the invention herein described for shielding electromagnetic field, radio frequency and microwave frequencies. Such metallized fabrics are available in woven, knitted and non-woven form and according to the invention, can also be produced in a form in which the metallized fabric is laminated to a suitable non-metallized liner fabric which may be of either a thin, natural or synthetic material. The metallized fabric can also be selected with regard to the plating being, for example, of copper, nickel, nickel on copper with the thickness of the plating will, in general, determine both the range of the frequencies that are shielded and the degree of attenuation all of which is known from the cited prior art and readily available trade literature.

In the embodiment being described, a woven "Flectron" copper/polyester so-called Ripstop type metallized fabric available from the Monsanto Chemical Company was laminated to a thin, non-woven synthetic, polyester liner so as to provide a composite sheet fabric having an electrically conducting surface on one side and a substantially non-electrically conducting surface on the opposite side. The "Flectron"fabric had a thickness of about 5 to 6 mils and a weight of about 2 to 2.5 oz/sq. yd. and had the frequency shielding characteristics associated with this type fabric. The referred to "Flectron" type fabric, typically woven or non-woven, is made up of individual metallized fibers which in the example being used for reference was a woven fabric made up of individual polyester fibers having a layer of copper, copper being a highly electrically conductive metal. With this type "Flectron" fabric, an attenuation effectiveness of up to about 90 Db is obtained in the 6 MHz to 10 GHz range.

Once the frequencies desired to be shielded are known and the particular metallized fabric has been selected and then bonded to the liner material as described above, a suitable number of panels 11 are cut from the fabric and are joined by sewn seams 24 reinforced by interior stitched tapes 15. The seams 24 at each join preferably join the edges of the panels in both physical and electrical contact. However, it has been found that even though complete electrical contact between the panel edges is not achieved substantial shielding may still be obtained. Six such panels are illustrated by way of example. The electrically conducting somewhat hemispherically-shaped thin surface formed by the thin metallized fabric is exposed on the outer surface of the crown of the cap and the electrically non-conducting thin liner material 17 is exposed on the interior of the crown. Thus, the crown of the cap in the illustrative embodiment has outwardly a unique and attractive copper appearance. A bill 13, in the form of a stiff panel, is attached to the crown of the cap 10 by conventional procedures and in the illustrative embodiment, is preferably of an extended length L of about five inches and has a width W at its trailing end of about eight inches. The metallized fabric 12 covers the outer surface of bill 13 and the metallized fabric 12' also preferably covers the inner surface of the bill 13. The bill 13 is preferably thin, relatively rigid and self-supporting and may comprise a rigid, fabric-covered panel. A metallized fabric-covered button 19, 19' enhances the overall copper-like, external appearance and strengthens the central join of the panels.

Figure 2:
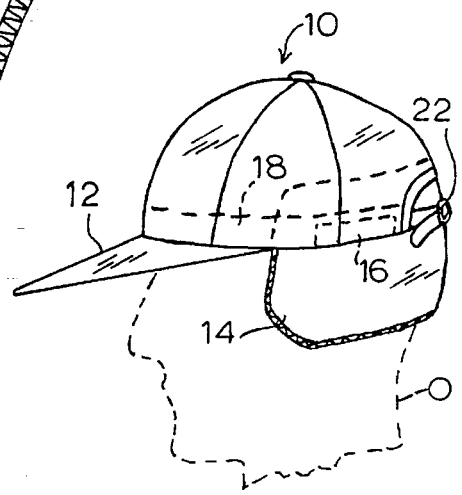
FIG. 2 illustrates in reduced size the cap of the invention in use with an auxiliary radiation shielding drape covering the back of the user's head and releasably attached to the crown of the cap.
Figure 3:
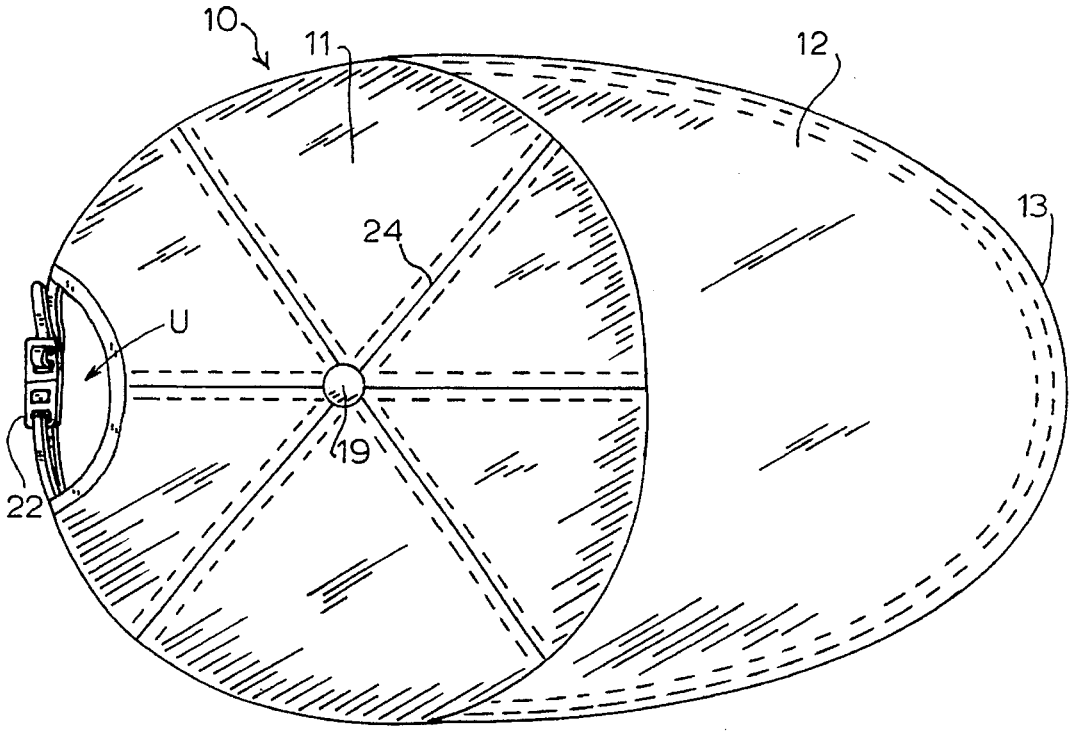
FIG. 3 is a top view of the cap of the invention.
Figure 4:
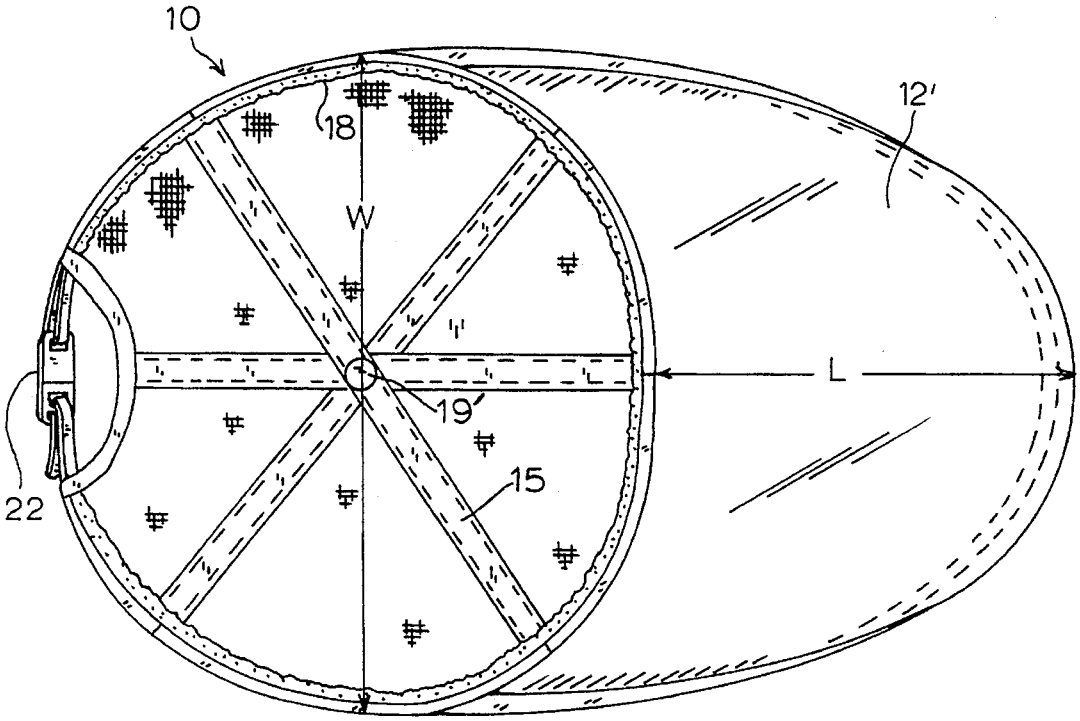
FIG. 4 is a bottom view of the cap of the invention.
Figure 6:
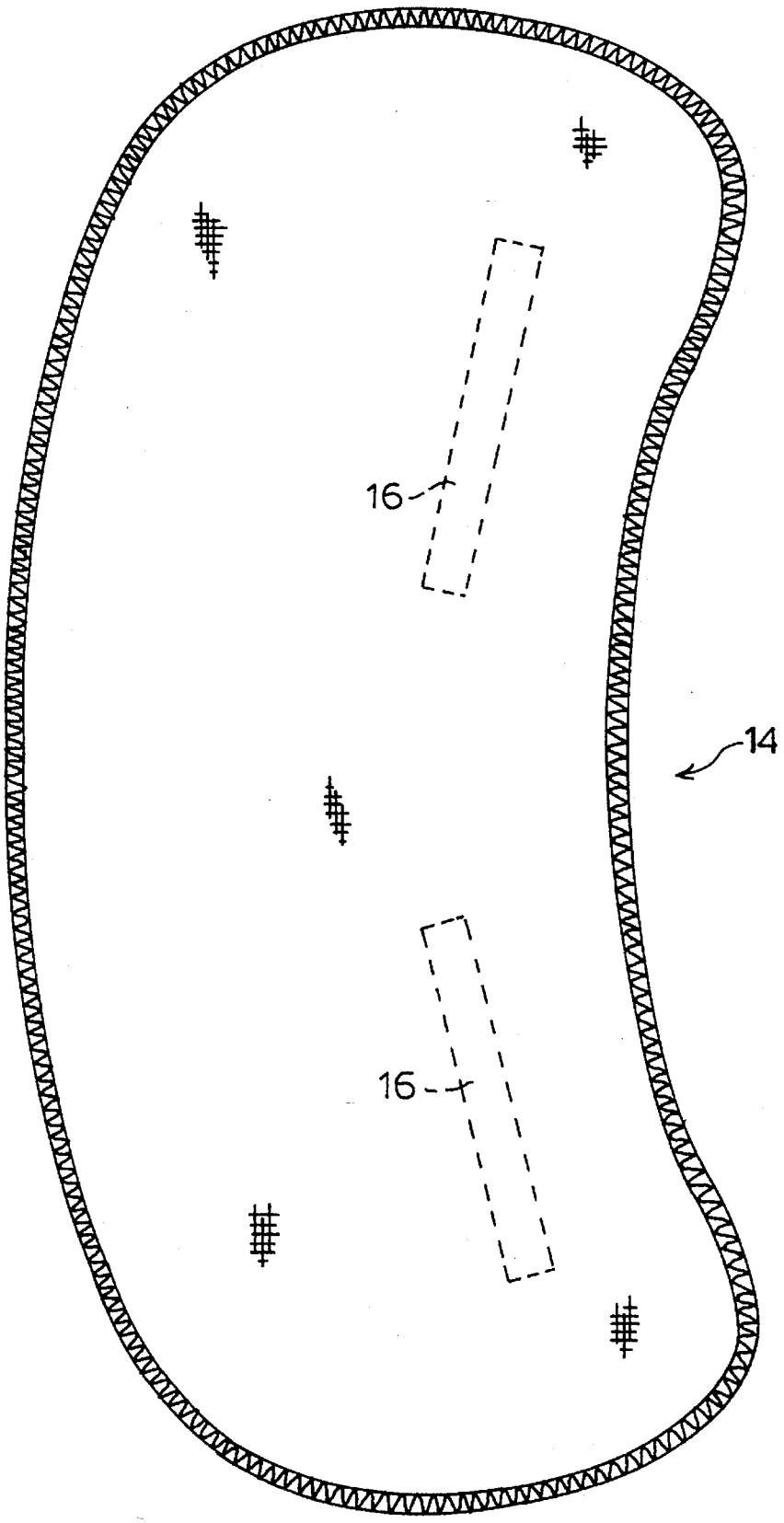
FIG. 6 is an enlarged inside view of the drape.

The previously mentioned somewhat inverted U-shaped opening U found in the conventional baseball cap also appears in the illustrative cap 10 of the invention and below which is mounted a conventional head size adjusting strap 22. Within the peripheral base portion of the crown of the cap, a strap 18 is sewn and has a fur-like surface suited to releasably engaging the mating "Velcro" type straps 16 fixed to the interior of a drape 14 which can be detachably secured to cap 10 as best seen in FIG. 2. Drape 14 is made of the same fabric as that employed for making the panels 11 and thus presents a continuing, attractive copper-metallized fabric appearance on its outer surface 14' and the appearance of the liner on its inner surface.

In use as illustrated in FIG. 1, the cap 10 of the invention finds application when an operator 0 is seated facing a computer having a screen 20 whose display is controlled by a keyboard 20' and which for purposes of describing the invention is treated as being an illustrative source of radiation depicted schematically by the arrows in FIG. 1. Thus, in this environment, it can be seen that cap 10 provides protection and attenuation of the radiation emitted by computer 20 both by reason of the crown portion of the cap 10 as well as by reason of the protruding, substantially large metallized surface of bill 12. In an alternative work environment as depicted in FIG. 2 where the operator 0 is concerned both about direct or reflected radiation aimed at the rear of the operator's head, additional protection is provided by installing the detachable cape 14 utilizing the "Velcro" straps 16 attached to the strap 18.

Utilizing the test described on Page 282 of the book "*Cross Currents*" by Robert O. Becker (1990), a small, portable AM radio was tuned to a spot on the dial where a station could not be heard and was adjusted to maximum volume. The radio in this condition was held about a foot away from both an operating television set and an operating microwave oven and in both instances, a radio frequency induced "noise" was heard on the radio. The same experiment was repeated with the radio wrapped within the cap 10 of the invention and no "noise" was heard thus illustrating that in these examples, the cap 10 of the invention can serve as a practical device for shielding both the head and brain and attenuating such undesired radiation.

As is amply illustrated by readily available and voluminous technical and medical literature, there is ample and growing concern about the effect on the body of electric, electromagnetic, and radio frequency fields. Thus, the cap 10 of the invention contributes to alleviating this concern.

In summary, the cap 10 of the invention as represented in the described illustrative embodiment, offers at least these advantages:

(1) The cap can be fabricated using existing cut and sew and other known fabrication techniques and thus does not require training in new manufacturing procedures.

(2) The individual panels making up the crown of the cap can be both physically and electrically joined by conventional sewing techniques.

(3) The available metallizing frequency shielding fabrics from which the cap can be fabricated are recognized as being suitable to existing and known cut and sew production and other established production procedures by being pliable, drapable, light weight and sewable.

(4) The cap, depending on the choice of fabric, can be tailored to fit the attenuation of selected frequencies deemed to be of the greatest concern.

(5) Both the cap and the drape in their appearance when worn provides a unique and distinctive copper-like metallized appearance.

(6) The cap, while serving the new and novel purpose of shielding the head and in particular the brain, remains equally serviceable as a baseball-type cap for use in activities not concerned with radiation shielding.

While an illustrative embodiment was used for purposes of illustration, it is to be recognized that other forms of caps and head covers may be devised to employ and benefit from the teachings of the invention. Accordingly, all such variations, modifications and embodiments are to be regarded as being within the spirit and scope of the invention.

I claim:

1. A covering for the head of a wearer in the form of a baseball-type cap, comprising:

(a) an upper flexible crown structure extending between top and base portions and shaped to flexibly fit and cover an upper portion of the head of a wearer of the cap;

(b) a bill structure formed as a relatively thin, self-supporting panel with inner and outer portions fixedly attached to and extending outwardly and forwardly from the base portion of said crown structure;

(c) a relatively thin, flexible metallized fabric formed of individual metallized synthetic fibers plated with a highly electrically conducting metal, having inner and outer surfaces, operative to attenuate with an effectiveness of up to about 90 Db electromagnetic field, radio and microwave frequencies within the 6 MHz to 10 GHz range directed toward either of said surfaces and suited to being formed as individual panels each with a peripheral edge capable of being both physically and electrically joined; and (d) said crown structure comprises a selected plurality of panels formed from said fabric, individual panels each having a peripheral edge, said panels being shaped and having the edges thereof substantially physically and electrically joined together to form said crown structure as a substantially integral, electrically conducting, imperforate and flexible outer surface.

2. A head covering as claimed in claim 1 wherein said fabric also covers and provides an integral electrically conducting imperforate surface over at least the outer portion of said bill structure and attenuates said frequencies when passed therethrough.

3. A head covering as claimed in claim 2 including a drape member detachably securable to said crown structure and having an outer integral electrically conducting imperforate surface comprising said metallized fabric adapted to provide shielding for a lower rearward head portion of a wearer of said cap.

4. A head covering as claimed in claim 1 wherein said fabric comprises a thin non-metallized fabric adhered to said metallized fabric and forming an inner substantially non-electrical conducting lining for said crown structure.

5. A head covering as claimed in claim 1 including a drape member detachably securable to said crown structure and having an outer integral electrically conducting imperforate surface comprising said metallized fabric adapted to provide shielding for a lower rearward head portion of a wearer of said cap.

6. A head covering as claimed in claim 5 wherein said crown structure includes a substantially inverted U-shaped opening in a rearwardly disposed, lower portion of said crown structure and said drape is shaped to cover said opening when attached to said crown structure and thereby provide shielding for said opening.

7. A covering for the head of a wearer as claimed in claim 1 wherein said edges are joined by sewn seams.

8. A covering for the head of a wearer as claimed in claim 1 wherein said fabric has a thickness of substantially 5–6 mils.

9. A cap for the head of a wearer serviceable both as a baseball-type head covering and as a means for shielding the head of a wearer and attenuating selected frequencies passed through the covering comprising:

(a) an upper flexible crown structure extending between top and base portions with inner and outer surfaces and shaped to fit and cover an upper portion of the head of a wearer of the cap;

(b) a bill structure formed as a relatively thin, substantially self-supporting panel with inner and outer surfaces fixedly attached to and extending outwardly and forwardly from the base portion of said crown structure;

(c) a relatively thin, flexible metallized fabric formed of individual metallized synthetic fibers plated with a highly electrically conducting metal and incorporated in and covering at least the outer surfaces of said crown and bill structures, said metallized fabric being operative to attenuate with an effectiveness of up to about 90 dB electromagnetic field, radio and microwave frequencies within the 6 MHz to 10 GHz range directed toward a head of the wearer of said cap and which in the absence of being attenuated would be transmitted through the said fabric covering said crown structure and suited to being formed as individual panels each with a peripheral edge capable of being both physically and electrically joined;

(d) said crown structure comprising a selected plurality of panels formed from said metallized fabric, individual panels each having a peripheral edge, said panels being shaped and having the edges thereto joined together both electrically and physically to form said crown structure as a substantially flexible integral, imperforate, electrically conducting surface;

(e) a flexible drape member detachably securable to said crown structure and having a substantially integral, electrically conducting, outer imperforate surface comprising said metallized fabric adapted to provide shielding for a lower rearward head portion of a wearer of said cap;

(f) said metallized fabric having a thin non-metallized fabric adhered thereto and forming an inner lining for said crown structure and said drape member; and (g) wherein said crown structure includes a substantially inverted U-shaped opening in a rearwardly disposed, lower portion of said crown structure and said drape is shaped to cover said opening when attached to said crown structure and provide shielding for said opening.

* * * * *

UNITED STATES PATENT AND TRADEMARK OFFICE

CERTIFICATE OF CORRECTION

PATENT NO. : 5,570,476

DATED : November 5, 1996

INVENTOR(S) : Bruce B. Olive

It is certified that error appears in the above-indentified patent and that said Letters Patent is hereby corrected as shown below:

Column 2, line 56, after "copper" add --tin or copper or silver on copper and which metal characteristics in conjunction--.

Signed and Sealed this

Seventh Day of January, 1997

*Attest:*

Bruce Lehman

BRUCE LEHMAN

*Attesting Officer*

*Commissioner of Patents and Trademarks*